US010511123B2

(12) United States Patent
Lin

(10) Patent No.: US 10,511,123 B2
(45) Date of Patent: Dec. 17, 2019

(54) INDUSTRIAL CONNECTOR AND CONNECTING STRUCTURE

(71) Applicant: SHENZHEN LINKO ELECTRIC CO., LTD., Shenzhen, Guangdong (CN)

(72) Inventor: Shunhua Lin, Guangdong (CN)

(73) Assignee: SHENZHEN LINKO ELECTRIC CO., LTD., Shenzhen (CN)

( * ) Notice: Subject to any disclaimer, the term of this patent is extended or adjusted under 35 U.S.C. 154(b) by 0 days.

(21) Appl. No.: 16/104,139

(22) Filed: Aug. 17, 2018

(65) Prior Publication Data

US 2018/0358746 A1 Dec. 13, 2018

Related U.S. Application Data

(63) Continuation of application No. PCT/CN2016/074009, filed on Feb. 18, 2016.

(51) Int. Cl.
*H01R 13/627* (2006.01)
*H01R 13/502* (2006.01)

(52) U.S. Cl.
CPC ..... *H01R 13/6277* (2013.01); *H01R 13/502* (2013.01)

(58) Field of Classification Search
CPC ..... H01R 13/639; H01R 13/6277; H01R 13/4361
USPC ..... 439/347, 349, 350, 352
See application file for complete search history.

(56) References Cited

U.S. PATENT DOCUMENTS 5,207,593 A * 5/1993 Bogiel ..... H01R 13/6275 439/345
5,603,630 A * 2/1997 Villain ..... H01Q 1/088 439/347
5,823,813 A * 10/1998 Dye ..... H01R 13/6277 439/347
7,438,579 B1 * 10/2008 Pellen ..... H01R 13/622 439/312
7,479,025 B2 * 1/2009 Lee ..... H01R 13/6277 439/349

(Continued)

FOREIGN PATENT DOCUMENTS

CN 201820962 U 5/2011
CN 203300888 U 11/2013
CN 204216309 U 3/2015

OTHER PUBLICATIONS

International Search Report of PCT Patent Application No. PCT/CN2016/074009 dated Nov. 23, 2016.

*Primary Examiner* — Tulsidas C Patel
*Assistant Examiner* — Marcus E Harcum

(57) ABSTRACT

The present invention discloses an industrial connector and a connecting structure. The industrial connector comprises a holder and a plug matingly connected to the holder, wherein the holder comprises: a hollow connecting cylinder; a connecting base fixed around an opening of the connecting cylinder; a buckle plate and an elastic component fixed within the connecting base, with buckles embedded into the connecting cylinder being provided on the buckle plate; and an elastic component which is connected to the buckles and used for driving the buckle plate to translate along the plane of the opening. The industrial connector provided by the present invention is easy to mount and reliable in connection.

12 Claims, 15 Drawing Sheets

(56) References Cited

U.S. PATENT DOCUMENTS

| | | | | |
|---|---|---|---|---|
| 7,785,127 | B2 * | 8/2010 | Nagamine | H01R 13/6277 439/347 |
| 2002/0132509 | A1 * | 9/2002 | Collin | H01R 13/6276 439/347 |
| 2005/0153593 | A1 * | 7/2005 | Takayanagi | F16L 37/088 439/352 |
| 2009/0309376 | A1 * | 12/2009 | Stachowiak, Jr. | F16B 2/08 292/256.6 |
| 2014/0235073 | A1 * | 8/2014 | Scorzelli | H01R 13/625 439/13 |
| 2018/0323543 | A1 * | 11/2018 | Koreeda | H01R 13/639 |
| 2018/0331471 | A1 * | 11/2018 | Zhang | H01R 13/639 |

* cited by examiner

INDUSTRIAL CONNECTOR AND CONNECTING STRUCTURE

CROSS REFERENCE TO RELATED APPLICATIONS

The present application is a Continuation Application of PCT Application No. PCT/CN2016/074009 filed on Feb. 18, 2016. All the above are hereby incorporated by reference.

TECHNICAL FIELD

The present invention relates to the field of connectors, and in particular to an industrial connector and a connecting structure.

BACKGROUND

As an automatically plugging and unplugging and self-locking device of high-precision and high-quality, industrial connectors are widely applied to various power sources and signals as well as challenging environments and occasions, for example, LED screens, medical facilities, industrial control, detection and measurement devices, AV systems, radio and television, communication, etc. The existing industrial connectors are mostly fixed by threads, which have low assembly efficiency and make it likely to cause man-made installation errors, influencing operation stability of the equipment.

A technical problem to be solved by the present invention is to provide an industrial connector which is easy to mount and reliable in connection.

SUMMARY

In view of the deficiencies in the prior art, an objective of the present invention is to provide an industrial connector and a connecting structure, which are easy to mount and reliable in connection.

For this purpose, the present invention employs the following technical solutions. An industrial connector comprising a holder and a plug matingly connected to the holder, wherein the holder comprises: a hollow connecting cylinder; a connecting base fixed around an opening of the connecting cylinder; a buckle plate and an elastic component fixed within the connecting base, with a buckle embedded in the connecting base being provided on the buckle plate; and an elastic component which is connected to the buckle and used for driving the buckle plate to translate along the plane of the opening.

The present invention further discloses a connecting structure for an industrial connector, comprising the holder of the present invention.

The present invention further discloses a connecting structure for an industrial connector, comprising the plug of the present invention.

In the prior art, the existing industrial connectors are mostly fixed by threads. This fixation method is labor-consuming and low in assembly efficiency; moreover, once an industrial connector is not tightened, the signal connection will be unstable, and the normal operation of the equipment will be influenced. In the present invention, by utilizing a translational buckle plate structure, fixation can be realized simply by inserting one protruded end of the industrial connector into the buckle, so that the assembly is quick and simple; moreover, if the industrial connector is not clamped in place, this problem will be found immediately by the assemblers, so that it is less likely to result in inappropriate insertion and the reliability is higher. In addition, in the present invention, by releasing in a translational manner, a joint at the protruded end of the industrial connector can be vertically plugged or unplugged. In comparison to the rotation method, the desired operating space is reduced significantly, and more industrial connectors can be mounted within a limited space of the equipment. In practical applications, even if there is a small operating space for the industrial connector, the industrial connector can also be smoothly plugged or unplugged. The translational buckle plate structure is simple in manufacturing process, high in yield and advantageous for reduction in the costs of the industrial connector. Since the buckle plate surrounds the opening, the number of buckles can be customized at will according to the application requirements, so that it is advantageous for the realization of multi-point fixation of a joint at one protruded end of the industrial connector and the connection of two ends of the industrial connector is firmer. Since the buckle plate is fixed around the opening of the connecting cylinder, the buckle plate is connected to the joint at one protruded end of the industrial connector.

The foregoing description merely shows the summary of the technical solutions of the present invention. In order to understand the technical means of the present invention more clearly to implement the technical means in accordance with the contents in the description and to make the above and other objects, features and advantages of the present invention more apparent and comprehensible, the detailed description will be given hereinafter by preferred embodiments with reference to the accompanying drawings.

BRIEF DESCRIPTION OF THE DRAWINGS

FIG. 23 is a schematic diagram of the connection of the industrial connector and a machine according to an embodiment of the present invention, in which:

Figure 1:
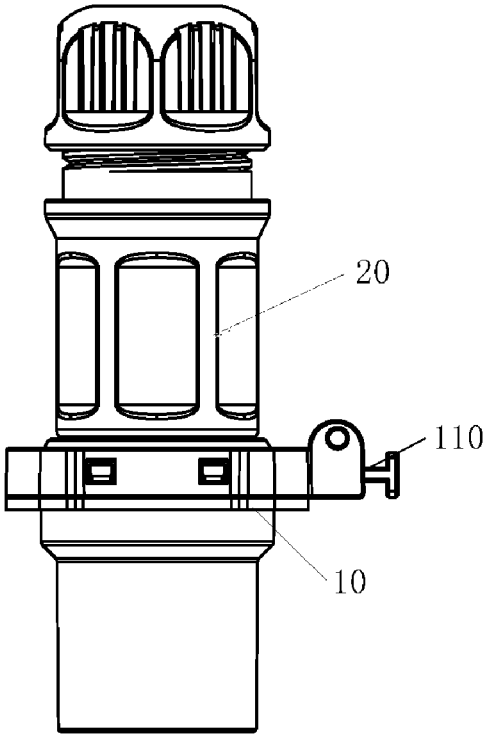
FIG. 1 is a schematic structure diagram of an industrial connector according to an embodiment of the present invention.
Figure 2:
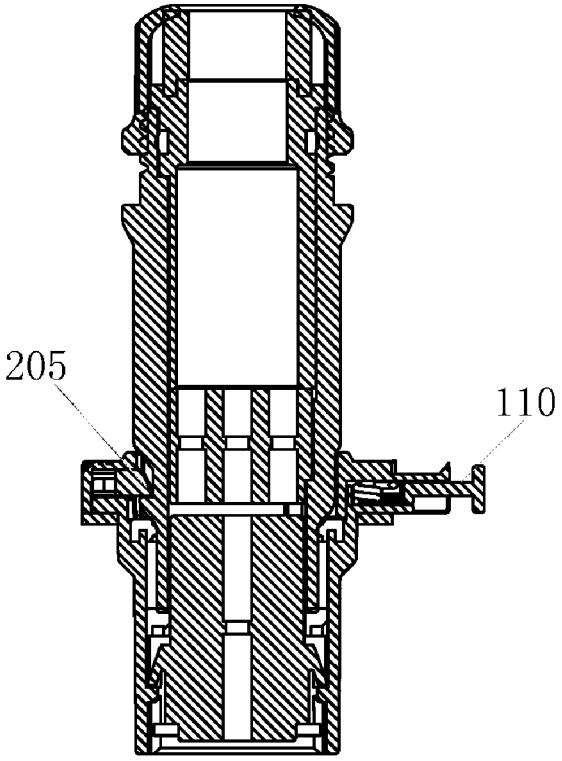
FIG. 2 is a sectional view of the industrial connector according to an embodiment of the present invention.
Figure 3:
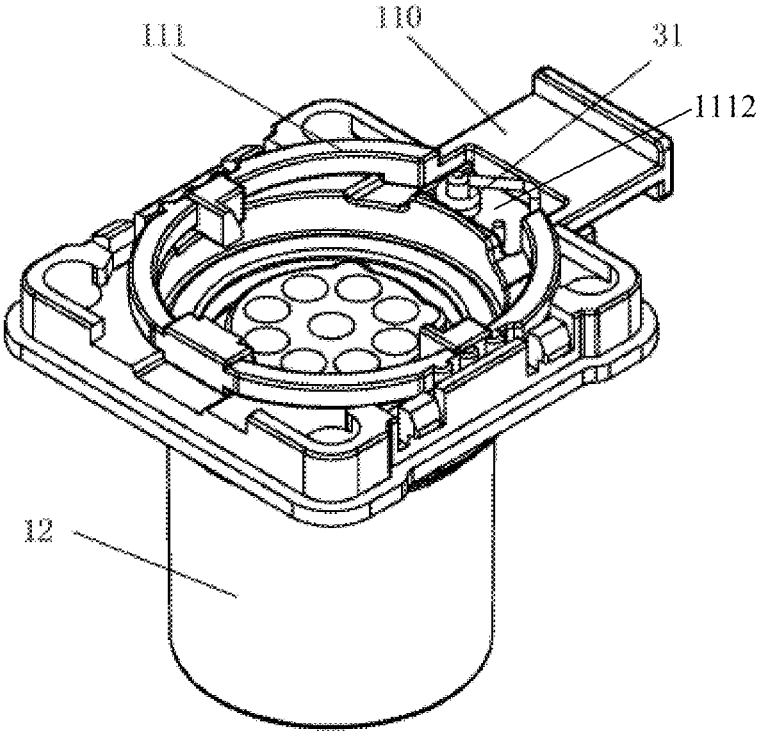
FIG. 3 is a schematic structure diagram of a connecting base according to an embodiment of the present invention.
Figure 4:
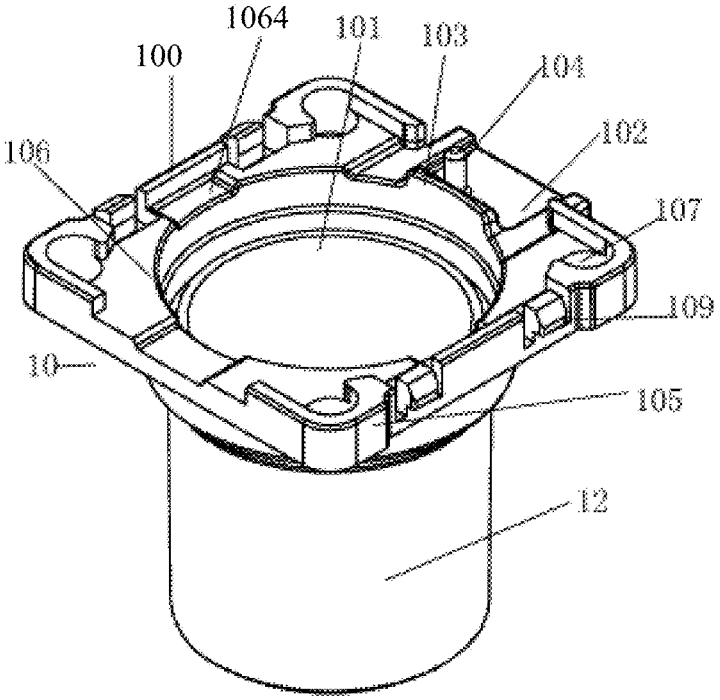
FIG. 4 is a schematic diagram of one of the structures of the connecting base according to an embodiment of the present invention.
Figure 5:
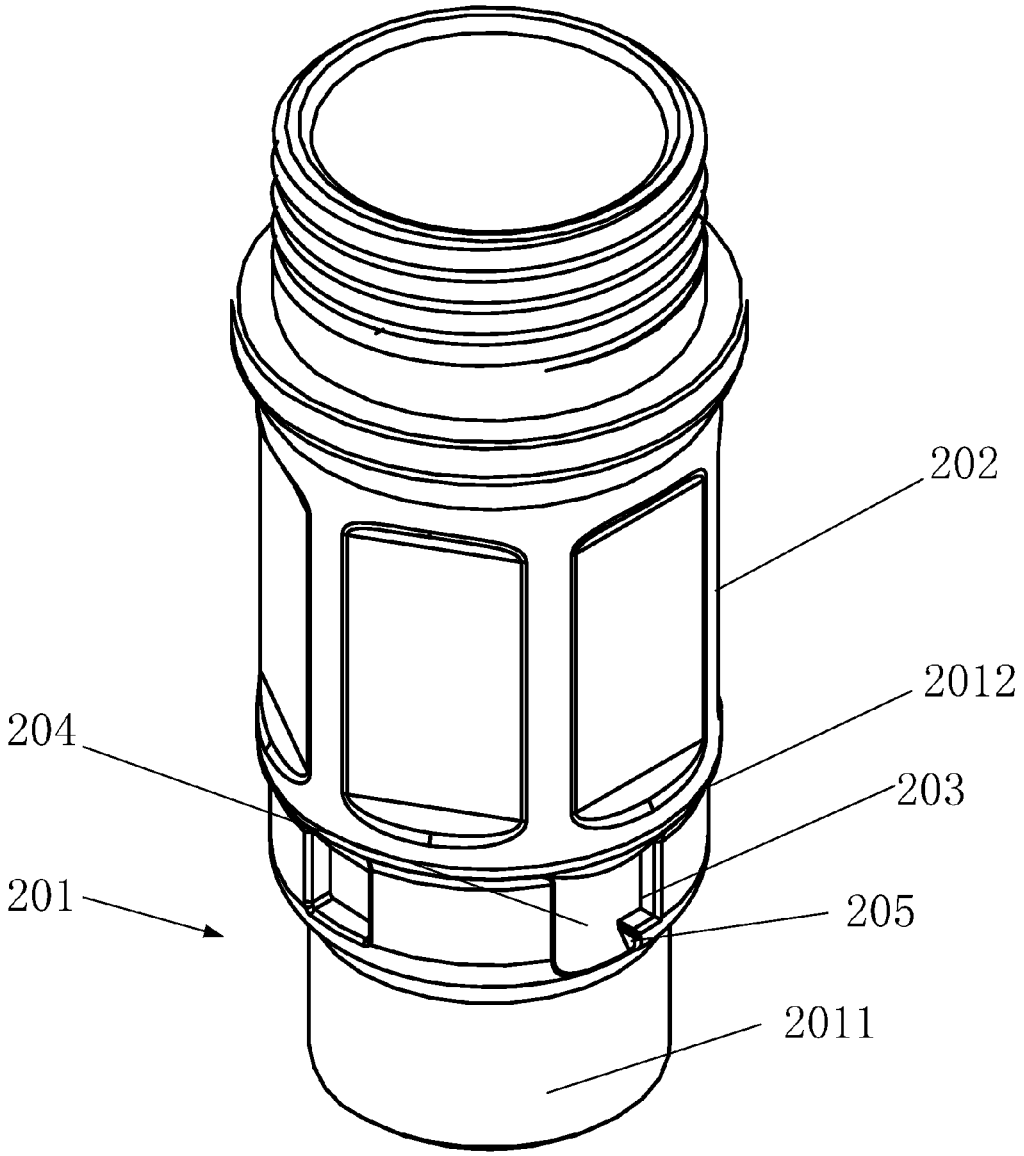
FIG. 5 is a schematic structure diagram of a plug according to an embodiment of the present invention.
Figure 6:
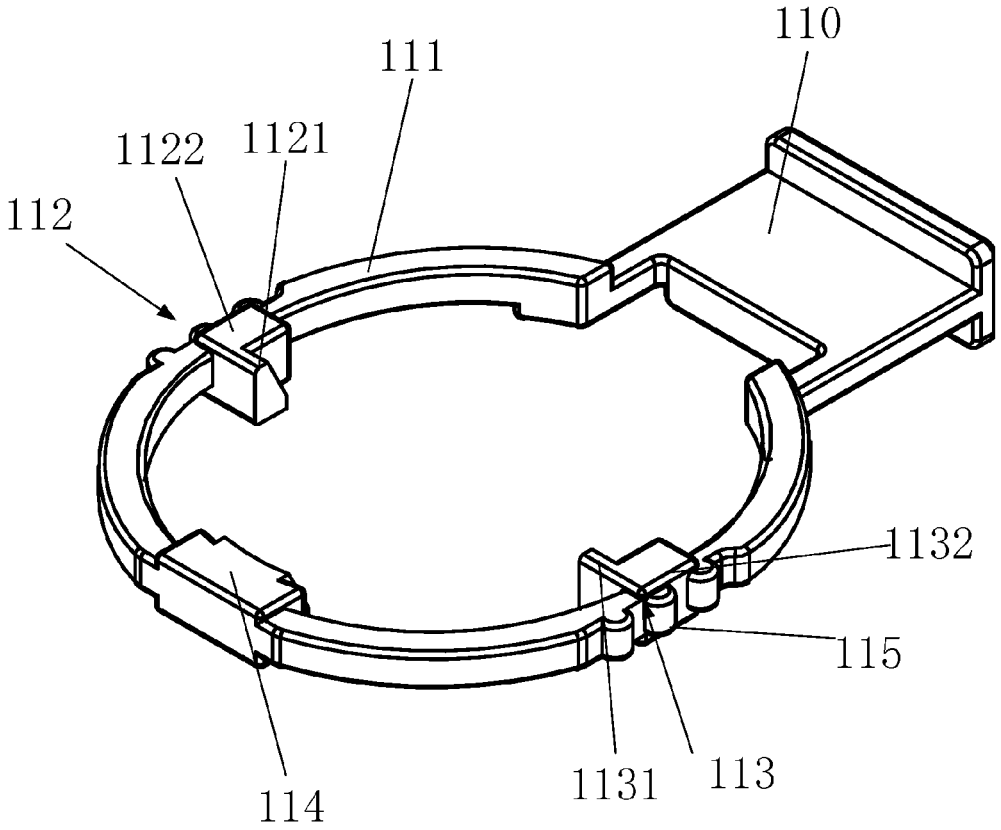
FIG. 6 is a schematic structure diagram of a buckle plate according to an embodiment of the present invention.

10: connecting base; 100: holder; 101: aperture; 102: gap; 103: baffle; 104: fixing column; 105: side wall; 106: support platform; 1064: avoiding groove; 107: fixing hole; 108: spring; 109: buckle portion; 11: buckle plate; 110: snap fastener; 1101: first snap fastener; 1102: second snap fastener; 111: lock ring; 1110: first lock ring; 1111: second lock ring; 1112: groove; 1113: slope; 112: first buckle; 1121: first buckle platform; 1122: first buckle base; 113: second buckle; 1131: second buckle platform; 1132: second buckle base; 114: third buckle; 115: cylindrical flange; 12: connecting cylinder; 13: panel; 131: limiting plate; 132: limiting hole; 133: annular flange; 134: punched hole; 135: buckle hole; 136: shaft hole; 137: lateral pin; 14: cover plate; 15: gasket; 16: waterproof collar; 17: waterproof gasket; 18: rubber core assembly; 19: waterproof gasket; 20: plug; 201: sleeve; 2011: first sleeve body; 2012: second sleeve body; 202: fixing cylinder; 203: side wall; 2301: first side wall; 2302: second side wall; 204: first bottom surface; 205: protruded portion; 206: slot; 207: bayonet; 21: nut; 22: wire clamping ring; 23: fixing assembly; 24: waterproof ring; 25: plastic core; 31: first torsion spring; 32: second torsion spring; 33: third torsion spring; 34: fourth torsion spring; and, 35: pit.

DETAILED DESCRIPTION

One or more specific embodiments of the present invention will be described and illustrated in the following detailed description with reference to the accompanying drawings. Providing these embodiments merely for illustrating and teaching rather than limiting, the present invention will be shown and described in detail so that those skilled in the art can implement the present invention.

It is understood that, in the description of the present invention, the orientation or positional relation indicated by terms "center", "transverse", "upper", "lower", "left", "right", "vertical", "horizontal", "top", "bottom", "inside", "outside" or the like is an orientation or positional relation shown based on the accompanying drawings, merely for describing the present invention and simplifying the description, rather than indicating or implying that the specified device or element must have a particular orientation or be constructed and operated in a particular orientation. Therefore, the terms should not be interpreted as limitations to the present invention. In addition, the terms "first" and "second" are merely for illustrative purpose, and should not be interpreted as indicating or implying the relative importance or implicitly indicating the number of the specified technical features. Therefore, the features defined by the terms "first" and "second" can explicitly or implicitly include one or more features. Unless otherwise stated, in the description of the present invention, "a plurality of" means two or more. In addition, the term "include" and any variant thereof are intended to cover non-exclusive inclusions.

It is to be noted that, unless otherwise expressly specified and defined, in the description of the present invention, the terms "mount", "joint" and "connect" should be interpreted in a broad sense. For example, the connection may be fixed connection, detachable connection or integral connection; or, may be mechanical connection or electrical connection; or, may be direct connection or indirect connection with an intermediate member; or, may be internal communication between two elements. An ordinary person of skill in the art may understand the specific meanings of the terms in the present invention according to specific circumstances. Generally, an industrial connector includes a connecting base fixedly connected to a machine, and a plug butt jointed with the connecting base. In the present invention, a panel, a connecting cylinder and a buckle may be provided on the connecting base or on the plug. For ease of explanation, in the following implementations, it is defaulted that the panel, the connecting cylinder and the buckle are provided on the connecting base.

The present invention will be further described below by preferred embodiments with reference to FIGS. 1-23.

The present invention provides an industrial connector. As shown, the industrial connector is high in precision and high in quality, and mainly applied to various power sources and signals for automatic plugging/unplugging and self-locking devices as well as various challenging environments and occasions, for example, LED screens, medical facilities, industrial control, detection and measurement devices, AV systems, radio and television, communication, etc. The industrial connector of the present invention will be described by taking the industrial connector being connected to a machine for example, specifically referring to the following embodiments.

The industrial connector in this embodiment includes a holder 100 and a plug 20 matingly connected to the holder 100. The holder 100 is fixedly connected to a machine. In this embodiment, the holder 100 is fixedly connected to the machine in a detachable way so as to realize the connection of the industrial connector to the machine. For example, the holder 100 and the machine are fixed by threaded connection or clamping connection.

The present invention provides an industrial connector, including a holder 100 and a plug 20 matingly connected to the holder 100, wherein the holder 100 includes: a hollow connecting cylinder 12; a connecting base 10 fixed around an opening of the connecting cylinder 12; a buckle plate 11 and an elastic component fixed within the connecting base 10, with a buckle embedded in the connecting base 10 being provided on the buckle plate 11; and an elastic component 108 which is connected to the buckle and used for driving the buckle plate 11 to translate along the plane of the opening.

The existing industrial connectors are mostly fixed by threads. This fixation method is labor-consuming and low in assembly efficiency; moreover, once an industrial connector is not tightened, the signal connection will be unstable, and the normal operation of the equipment will be influenced. The present invention uses a translational buckle plate 11 structure, and fixation can be realized simply by inserting one protruded end of the industrial connector into a buckle, so that the assembly is quick and simple; moreover, if the industrial connector is not clamped in place, this problem will be found immediately by assemblers, so that it is less likely to result in inappropriate insertion and the reliability is higher. In addition, in the present invention, by releasing in a translational manner, the plug can be vertically plugged or unplugged. In comparison to the rotation method, the required operating space is reduced significantly, and more industrial connectors can be mounted within a limited space of the equipment. In practical applications, even if there is a small operating space for the industrial connector, the industrial connector can also be smoothly plugged or unplugged. The translational buckle plate structure is simple in manufacturing process, high in yield and advantageous for reduction in the costs of the industrial connector. Since the buckle plate 11 surrounds the opening, the number of buckles can be customized at will according to the application requirements, so that it is advantageous for the realization of multi-point fixation of the plug and the connection of two ends of the industrial connector is firmer. Since the buckle plate 11 surrounds the opening of the connecting cylinder 12, the contact area of the buckle plate 11 with the plug 20 becomes larger, a plurality of buckles can be provided, and the connection strength is improved.

The holder 100 includes a hollow connecting cylinder 12; a connecting base 10 fixed around an opening of the connecting cylinder 12; a buckle plate 11 and an elastic component fixed within the connecting base 10, with buckles embedded into the connecting base 10 being provided on the buckle plate 11; and an elastic component which is connected to the buckles and used for driving the buckle plate 11 to translate along the plane of the opening.

The plug 20 includes a jacket. The jacket includes a sleeve 201 to be embedded into the holder 100 of the industrial connector and a fixing cylinder 202 connected to the sleeve 201. A space for mounting a cable joint is provided within the fixing cylinder 202. A cable positioning structure is provided at one end of the fixing cylinder 202 away from the sleeve 201. A clamping structure is provided at one end of the sleeve 201 close to the fixing cylinder 202. The jacket may be made of metal or plastic material, preferably alloy material. Thus, it can provide high degree of protection and is resistant to wear.

In the present invention, with only one jacket, the plug 20 can realize the fixation of a cable joint and the fitting with the holder 100 of the industrial connector, and the clamping structure is formed directly on the outer wall of the sleeve 201 so as to form an integral structure; and, the external structure of the whole plug 20 is very simple. Since the structure is simpler, the degree of integration is higher, and it is easier to manufacture. The labor-consumption for assembling is greatly reduced, and the production efficiency can be significantly increased. Since the product is simple in structure, the probability of errors between parts of the product when in use is reduced. In addition, the position of the clamping structure directly influences the design of the waterproof structure. If the clamping structure is provided at the opening of the sleeve 20, attention should be paid to avoiding the clamping structure in the design of the waterproof structure, and therefore the difficulty of design and manufacture will be increased greatly. In the present invention, the sleeve 201 structure is close to one end of the connecting cylinder 12, the wall from the clamping structure to the open end of the sleeve 201 can be inserted into the holder 100 as a whole, and a waterproof structure can be provided on the holder 100 within this section of the wall, without paying attention to avoiding the clamping structure. Accordingly, the design difficulty of the waterproof structure is reduced, the contact area is large, and the waterproof effect is better.

During mounting, the sleeve 201 of the plug 20 is extended into the connecting cylinder 12 through an aperture on the holder 100, and a positioning mechanism on the sleeve 201 is fitted with an outer edge of a rubber assembly to realize a guide effect. Thus, it is ensured that the clamping structure on the sleeve 201 is connected to buckles on the buckle plate 11 surrounding the opening of the connecting cylinder 12, the buckle plate 11 is driven to translate along the plane of the opening, and the detachable connection of the plug 20 with the holder 100 can be realized.

Specifically, the connecting base 10 includes an aperture 101, a gap 102, a baffle 103, a fixing column 104 and a side wall. The connecting base is recessed from top to bottom to form an accommodation space, the recess forms a support platform, and the outer edge of the recess forms a side wall. The buckle plate 11 is located on the support platform 106. A through hole is provided in the center of the connecting base 10. The baffle 103 is extended upward from the edge of the through hole, and the gap 102 is provided on the side wall extending from the baffle 103 to the direction of the external side wall. The fixing column 104 is provided between the gap 102 and the baffle 103. An avoiding groove 1064 is provided on the support platform 106. Fixing holes 107 are provided at four corners of the connecting base 10. Of course, there may also be three or two fixing holes 107, and this will not be limited here. The holder 100 is mounted on a casing of the machine by screws passing through the fixing holes 107, and the connecting cylinder is embedded into the machine. In this way, the end face of the whole connecting base 10 is flat and will not be protruded from the surface of the casing of the machine, so that the connecting base 10 is prevented from damage during transportation and usage of the machine.

The buckle plate 11 includes a snap fastener 110 and a pusher. The snap fastener 110 is connected to the pusher. The snap fastener 110 includes a lock ring 111 and a buckle. The lock ring 111 is of a closed-loop structure, and the buckle is provided on an inner side of an annular arm of the lock ring 111. The buckle includes a buckle base and a buckle platform. The buckle base is provided on the inner side of the annular arm of the lock ring 111, and the buckle platform is extended along the buckle base to the center of the aperture on the connecting base 10.

Specifically, the lock ring 111 is located on the support platform 106 around the through hole on the connecting base 10, the buckle base is located within the avoiding groove 1064, the pusher is extended out from the side wall 105 of the connecting base 10 along the gap 102, and the pusher is pressed in parallel to drive the lock ring 111 to translate.

In this technical solution, a specific buckle plate 11 structure is disclosed, and the snap fastener 110 is pushed to translate by the pusher, so that it can be convenient to realize lock release and pull out the plug 20.

The snap fastener 110 forms a lock ring 111 of a closed-loop structure, and the buckle is provided on the inside wall of the lock ring 111. The lock ring 111 may be circular or rectangular. Of course, the lock ring 111 may also be in other shapes. In this embodiment, the shape of the lock ring 111 is merely for better description of this embodiment, and the lock ring 111 is not limited to being circular or rectangular.

Specifically, the pusher includes a snap fastener integrated with the lock ring 111. The lock ring 111 is located on the support platform 106, and a buckle is provided on an inner annular arm of the lock ring 111. The buckle is provided on a center line between the buckle and the through hole on the connecting base 10. A torsion spring is sleeved on the fixing column 104. One end of the torsion spring is rested against the baffle 103, while the other end thereof is fixedly connected to the snap fastener 110. By pressing the snap fastener 110, the lock ring 111 and the buckle are pushed to translate.

The lock ring 111 of a closed-loop structure is simple in structure and easy to manufacture and assemble. In addition, since the lock ring 111 surrounds the whole opening, the buckle may be provided at any position corresponding to the opening, so that the requirements in various plug fixation occasions may be satisfied, and the range of application is wide. Meanwhile, after the plug is inserted into the lock ring 111, the plug is surrounded by the lock ring 111, so that it is advantageous to realize the omnidirectional fixation of the plug and the fixation is firmer. Moreover, the lock ring 111 of a closed-loop structure can be unlocked by only one snap fastener 110. Therefore, when in use, an operator can control the snap fastener by only one finger, and he can use other fingers to hold the plug for a plugging or unplugging operation, thereby realizing one-hand operation. Moreover, by one-hand operation, the time is saved, and the operation efficiency can be improved in a large-scale wiring occasion. In addition, in some dangerous operation occasions, for example, high-altitude operation, if the plugging or unplugging operation can be realized by one hand, it means that the personal safety of the operator can be ensured by the other hand, and the safety can be improved greatly. Meanwhile, in the technical solution, two specific shapes of the lock ring 111 are disclosed, so that the lock ring is adapted to the requirements of different industrial connectors and has a wide range of application.

As a further improvement of this embodiment, the buckle comprises a first buckle 112 and a second buckle 113 which are symmetrically provided at two sides of the snap fastener. A first avoiding hole 132 and a second avoiding hole 132 are provided on the support platform 106 of the connecting base 10. A first buckle base 1122 of the first buckle 112 is located within the first avoiding hole, and a second buckle base 1132 of the second buckle 113 is located within the second avoiding hole 132. It is also possible that no avoiding hole 132 is provided on the support platform 106. The bottom surfaces of the buckle bases and the bottom surface of the lock ring 111 are in a same plane. A torsion spring is sleeved on the fixing column 104. One end of the torsion spring is rested against the baffle 103, while the other end thereof is fixedly connected to the snap fastener. By pressing the snap fastener, the lock ring 111 and the buckles are pushed to translate.

In the technical solution, a structure having two buckles is disclosed. Since the two buckles are provided symmetrically and stressed uniformly, stable fixation can be realized with less buckles and low costs.

Figure 7:
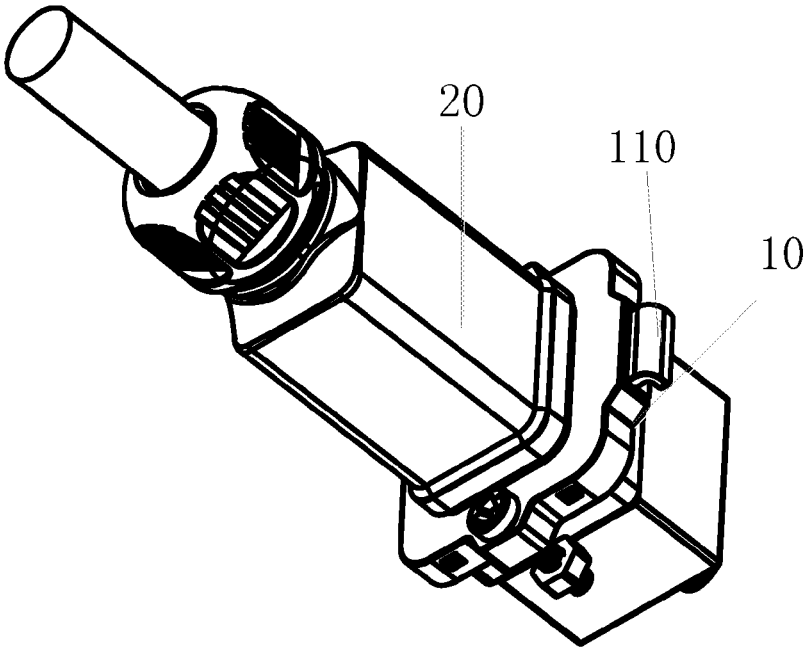
FIG. 7 is a schematic structure diagram of a rectangular industrial connector according to an embodiment of the present invention.
Figure 8:
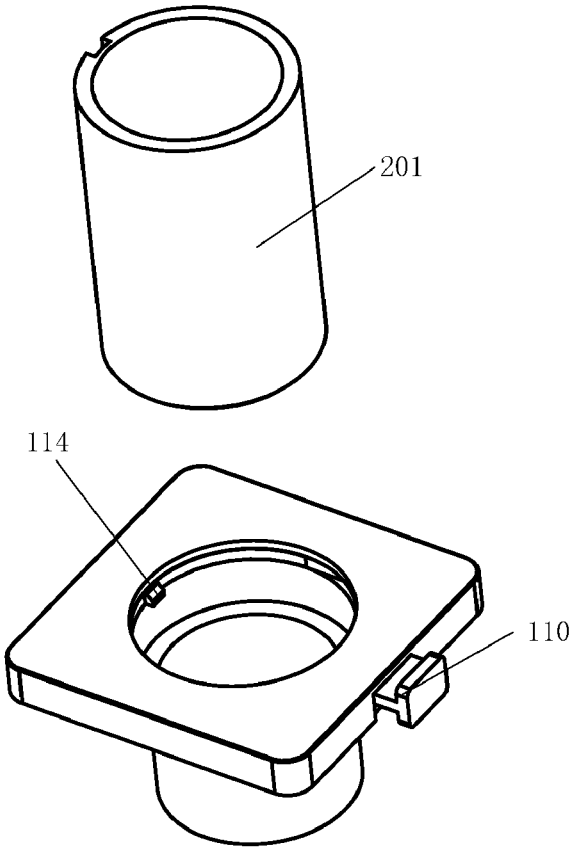
FIG. 8 is a schematic structure diagram of the fitting of the sleeve with the connecting base according to an embodiment of the present invention.
Figure 9:
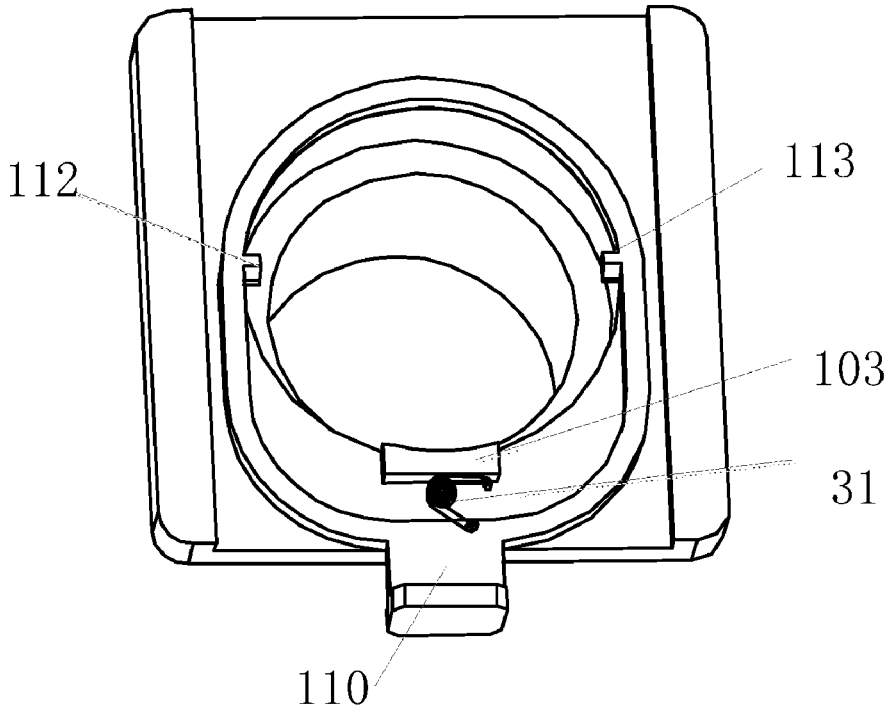
FIG. 9 is a schematic diagram of one of the structures of the connecting base according to an embodiment of the present invention.
Figure 10:
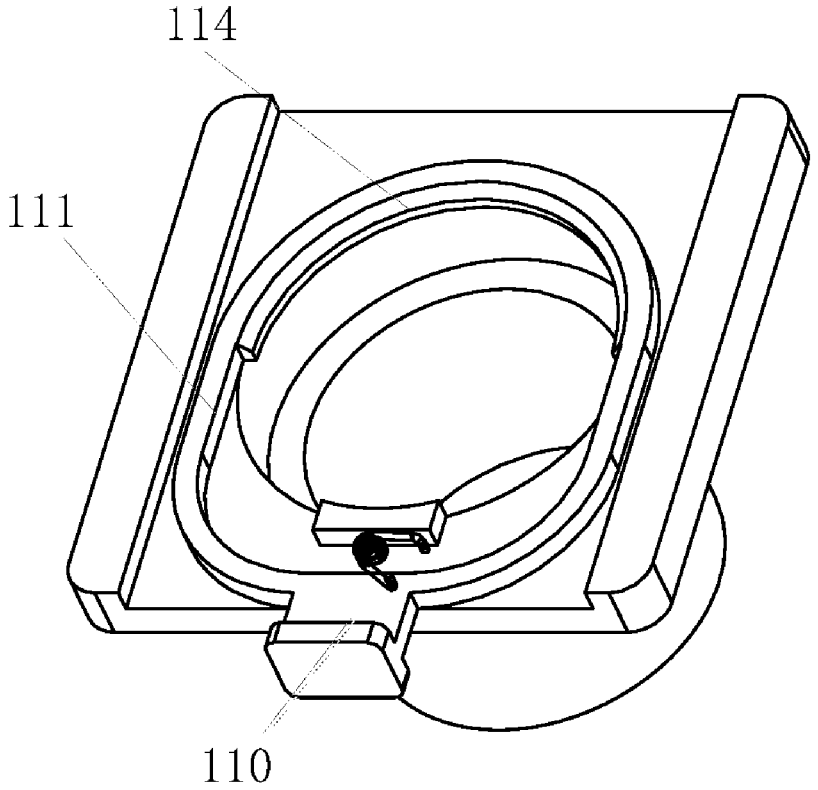
FIG. 10 is a schematic diagram of one of the structures of the connecting base according to an embodiment of the present invention.
Figure 11:
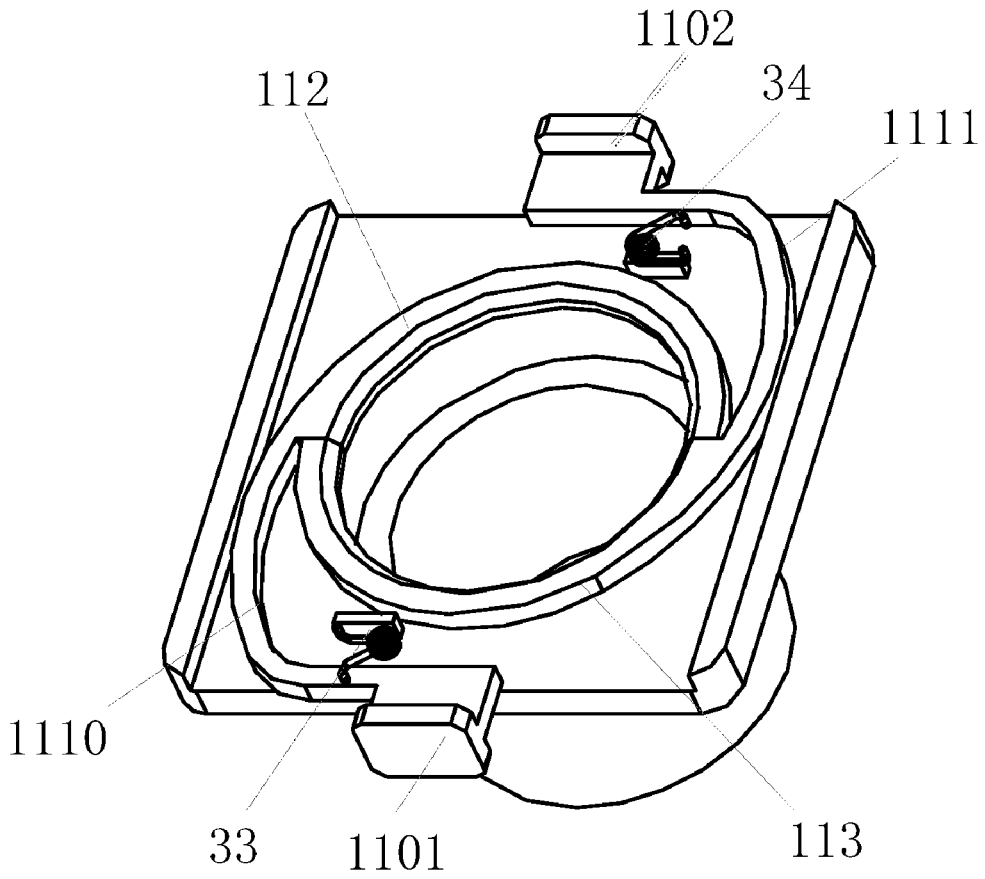
FIG. 11 is a schematic diagram of one of the structures of the connecting base according to an embodiment of the present invention.

As a further improvement of this embodiment, as shown in FIG. 7, the buckle comprises a first buckle 112, a second buckle 113 and a third buckle 114. The first buckle 112 and the second buckle 113 are symmetrically provided at two sides of the snap fastener, and the third buckle 114 is provided at a side opposite to the snap fastener. A first avoiding hole, a second avoiding hole and a third avoiding hole are provided on the support platform 106 of the connecting base 10. A first buckle base 1122 of the first buckle 112 is located within the first avoiding hole, a second buckle base 1132 of the second buckle 113 is located within the second avoiding hole, and a third buckle base of the third buckle 114 is located within the third avoiding hole. A cylindrical flange 115 is provided at the side of the buckle base of each of the first buckle 112 and the second buckle 113 facing the side wall. There may be one, two or more cylindrical flanges 115. The side wall opposite to the cylindrical flange 115 is a flat limiting plate 131, and hooks 108 are provided at two sides of the limiting plate 131 on the outer side of the side wall. A torsion spring is sleeved on the fixing column 104. One end of the torsion spring is rested against the baffle 103, while the other end thereof is fixedly connected to the snap fastener. By pressing the snap fastener, the lock ring 111 and the buckles are pushed to translate.

In this technical solution, a structure having three buckles is disclosed. The second buckle and the first buckle are symmetrically provided at two sides, and the third buckle is provided opposite to the snap fastener, i.e., at a position on a symmetric line between the first buckle and the second buckle, so that the three buckles can be stressed uniformly and the fixation is firmer.

In this embodiment, the buckle may also comprise a plurality of buckles. In this embodiment, the buckle comprises a fixed form of one buckle, a fixed form of two buckles, a fixed form of three buckles and a fixed form of annular buckles. These forms are merely to better describe the embodiments of the present invention, and one should not think that the buckle only comprises these buckle forms. Meanwhile, the buckle comprising a first buckle, a second buckle and a third buckle and the buckles being connected at three points is used as a preferred implementation of the embodiments of the present invention.

As a further improvement of this embodiment, a groove 1112 is provided within the lock ring 111, the bottom surface of the groove 1112 is a slope 113; the snap fastener is provided within the groove 1112, a spring 108 is provided at the bottom of the snap fastener; and the edge of the bottom fits with the bottom surface of the groove 1112 to push the lock ring 111 to translate. Correspondingly, the elastic component comprises a second torsion spring 32; a pit 35 for accommodating the second torsion spring 32 is provided on the holder on at least one side of the groove; and, one end of the second torsion spring 32 is rested against an inner side of lock ring, while the other end thereof is rested against the holder.

In this technical solution, the snap fastener is moved in a direction perpendicular to the opening, and the snap fastener is provided within the groove 1112 of the lock ring 111. Therefore, it is not required to additionally widen the holder 100 during the mounting of the snap fastener, so that it is advantageous to further reduce the area occupation of the industrial connector.

The pusher comprises a prod plate integrated with the lock ring 111. The lock ring 111 surrounds the outer edge of the through hole on the connecting base 10. Buckles are provided on an inner edge of the lock ring 111. The prod plate is extended from the gap 102 to the outside of the side wall of the connecting base 10. The baffle 103 is provided on the connecting base 10, and the baffle 103 is provided at the side opposite to the prod plate and away from the through hole of the connecting base 10. One end of the spring is rested against the baffle 103, while the other end thereof is fixedly connected to the side wall of the connecting base 10. When the prod plate is prodded outward, the lock ring 111 drives the buckles to translate outward. When the prod plate is released, the lock ring 111 returns to its original position. For those skilled in the art, without paying any creative effort, the translation of the buckles on the connecting plate 10 can be realized by horizontally prodding, horizontally pressing, obliquely prodding or obliquely pressing the pusher.

As a further improvement of this embodiment, an annular buckle is provided on the annular arm of the lock ring 111, the annular buckle is provided at the side opposite to the snap fastener, the annular buckle is an annular flange extending along the annular arm of the lock ring 111, and the annular flange does not go beyond a semicircle.

Figure 12:
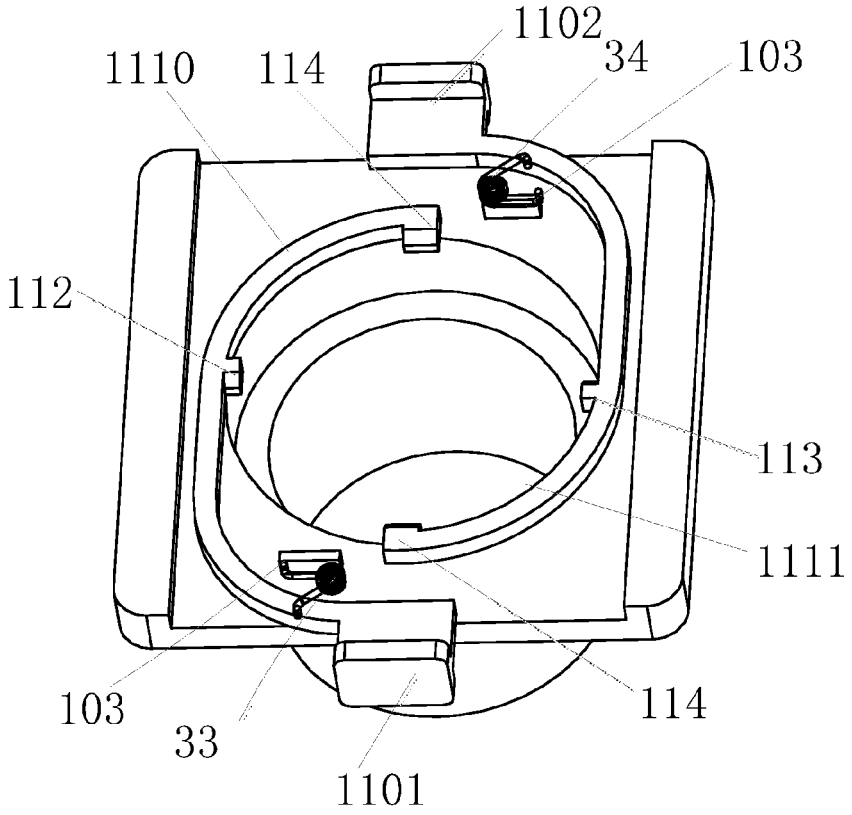
FIG. 12 is a schematic diagram of one of the structures of the connecting base according to an embodiment of the present invention.
Figure 13:
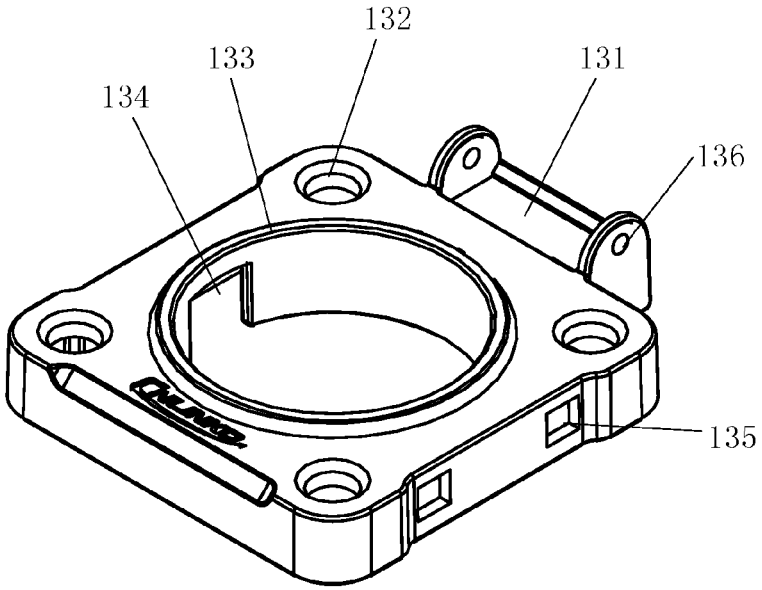
FIG. 13 is a schematic structure diagram of a panel according to an embodiment of the present invention.
Figure 14:
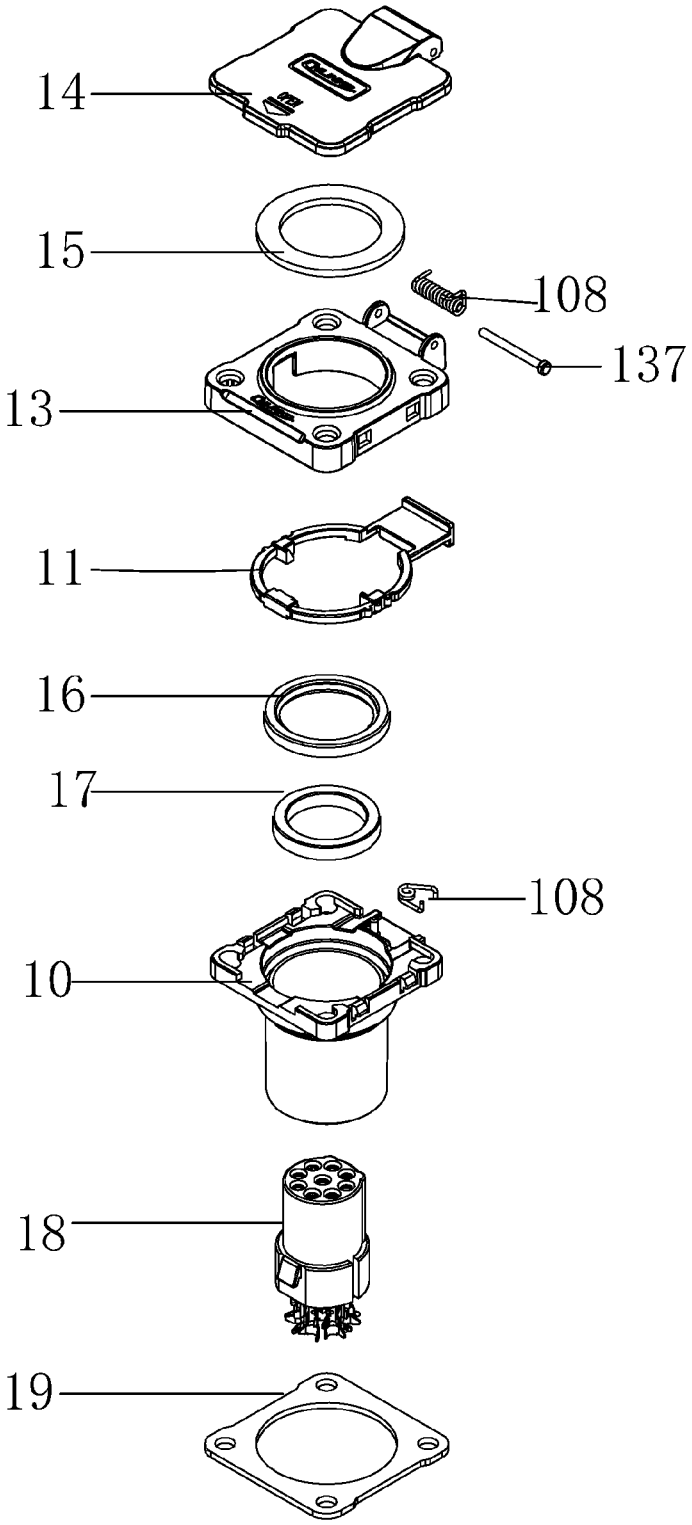
FIG. 14 is an exploded structure diagram of the connecting base according to an embodiment of the present invention.
Figure 15:
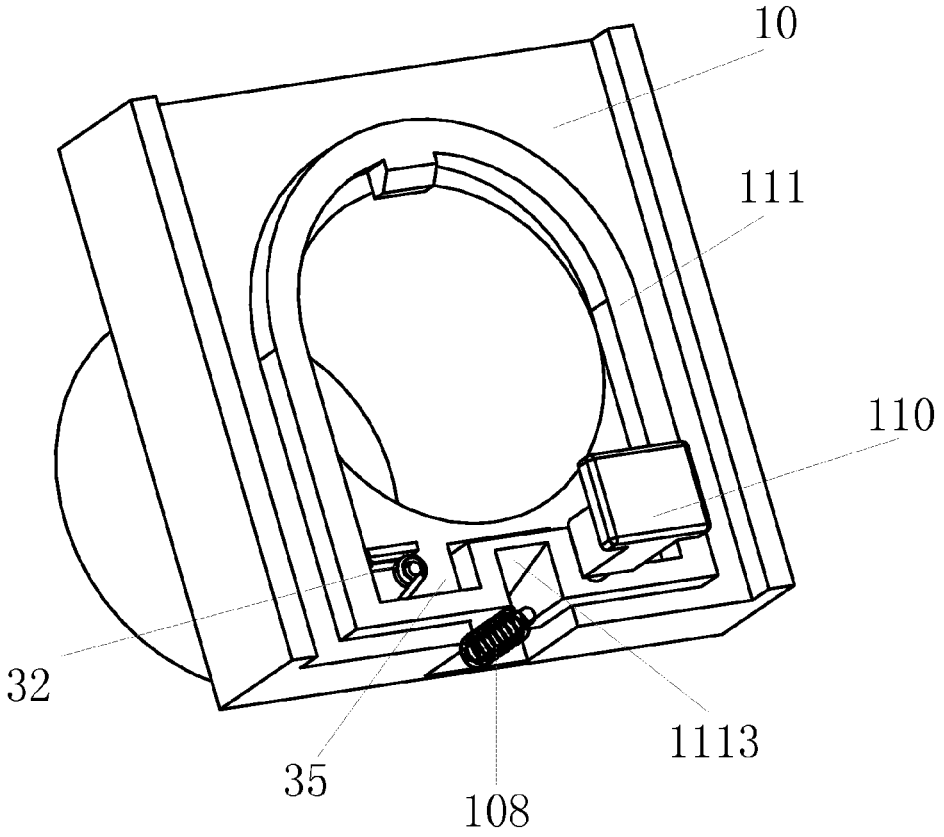
FIG. 15 is a schematic diagram of one of the structures of the connecting base according to an embodiment of the present invention.
Figure 16:
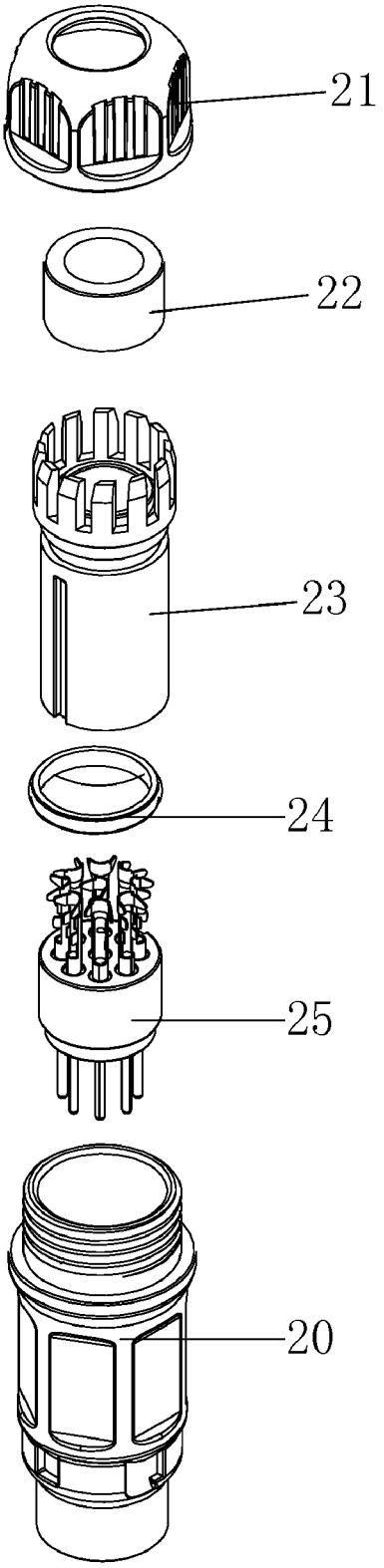
FIG. 16 is an exploded structure diagram of the plug according to an embodiment of the present invention.
Figure 17:
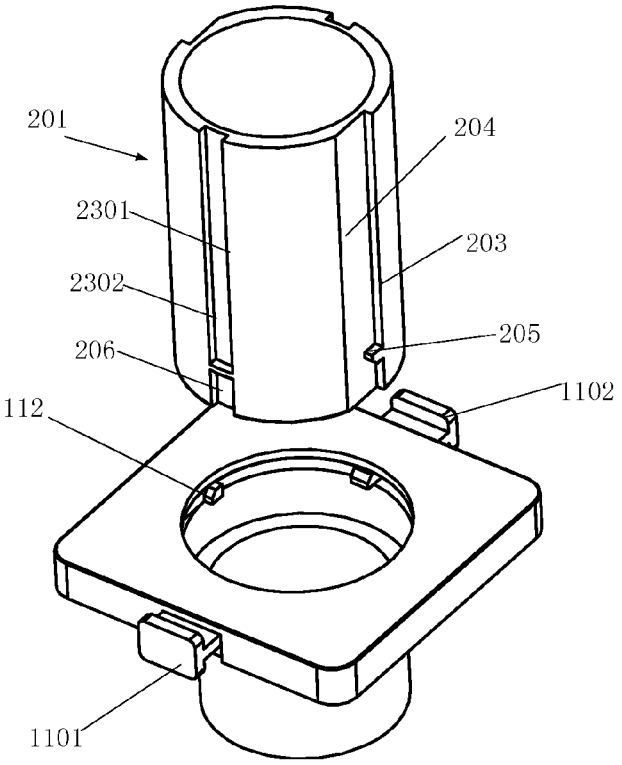
FIG. 17 is a schematic structure diagram of the fitting of the sleeve with the connecting base according to an embodiment of the present invention.
Figure 18:
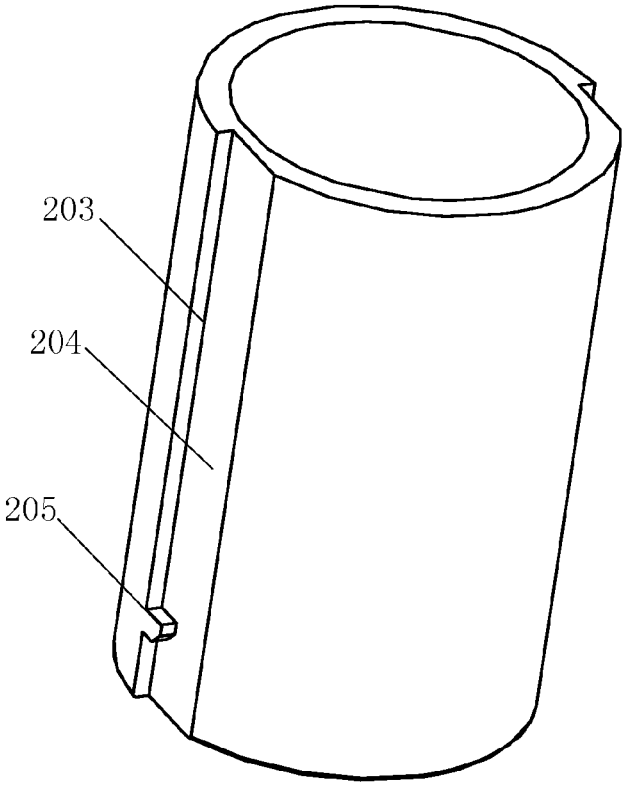
FIG. 18 is a schematic structure diagram of a sleeve according to an embodiment of the present invention.
Figure 19:
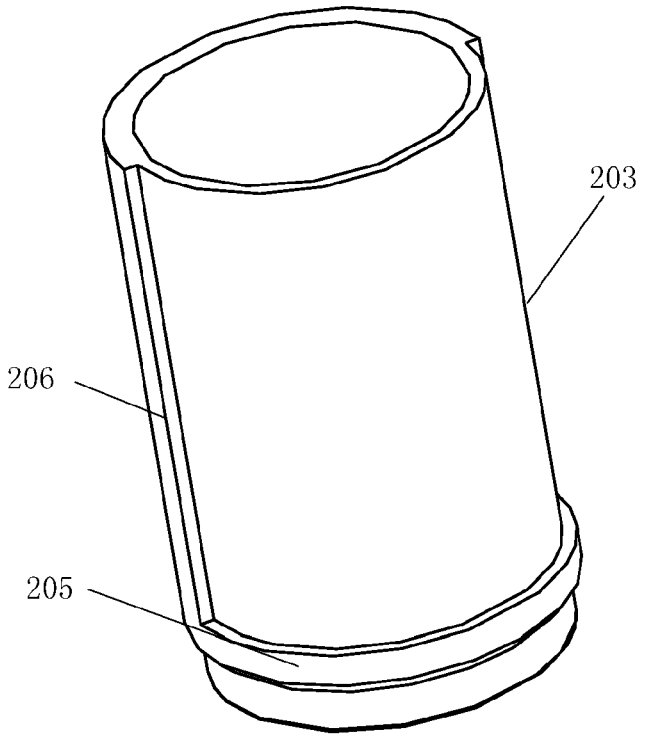
FIG. 19 is a schematic structure diagram of the sleeve according to an embodiment of the present invention.
Figure 20:
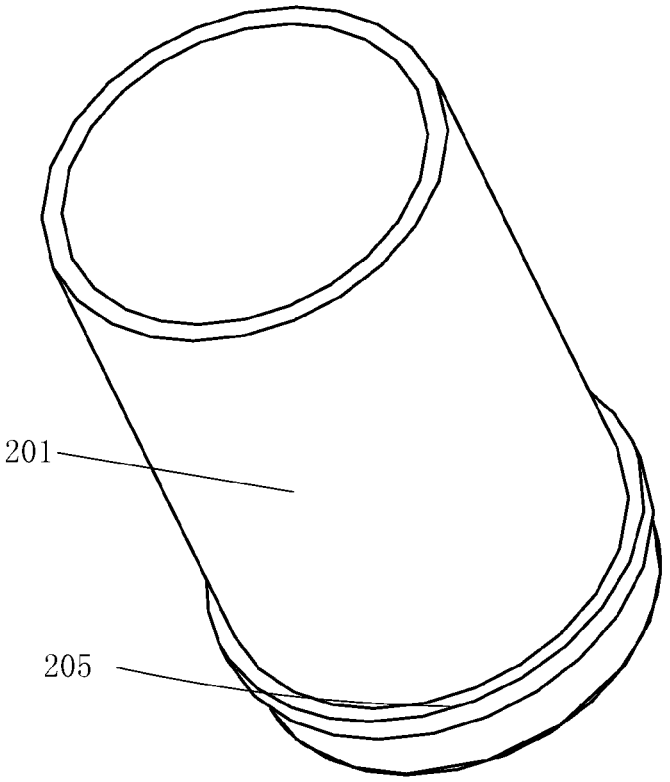
FIG. 20 is a schematic structure diagram of the sleeve according to an embodiment of the present invention.
Figure 21:
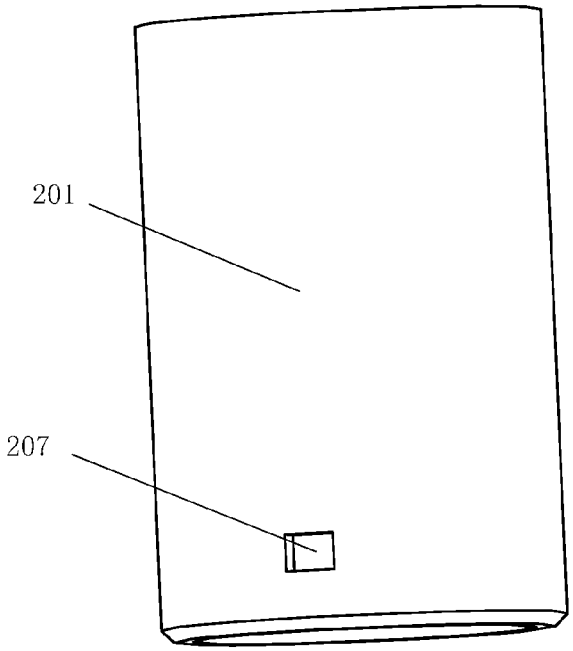
FIG. 21 is a schematic structure diagram of the sleeve according to an embodiment of the present invention.
Figure 22:
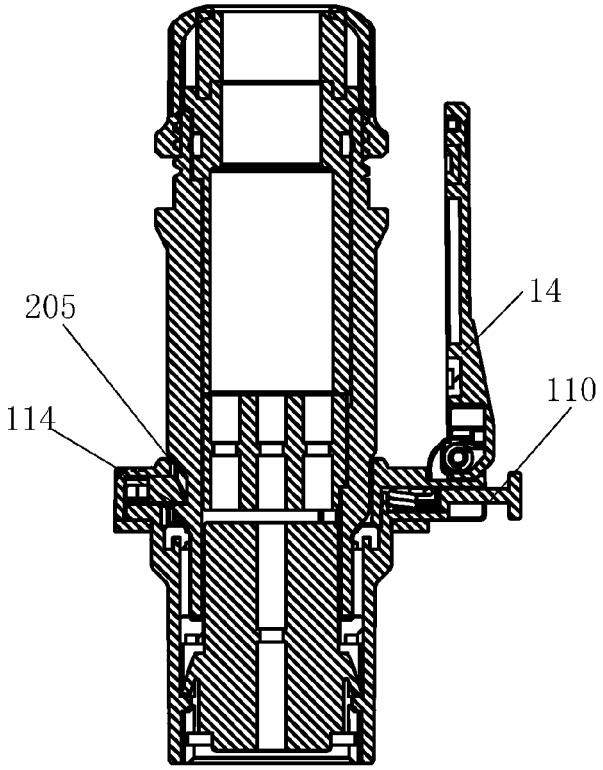
FIG. 22 is a sectional view of the industrial connector according to an embodiment of the present invention.
Figure 23:
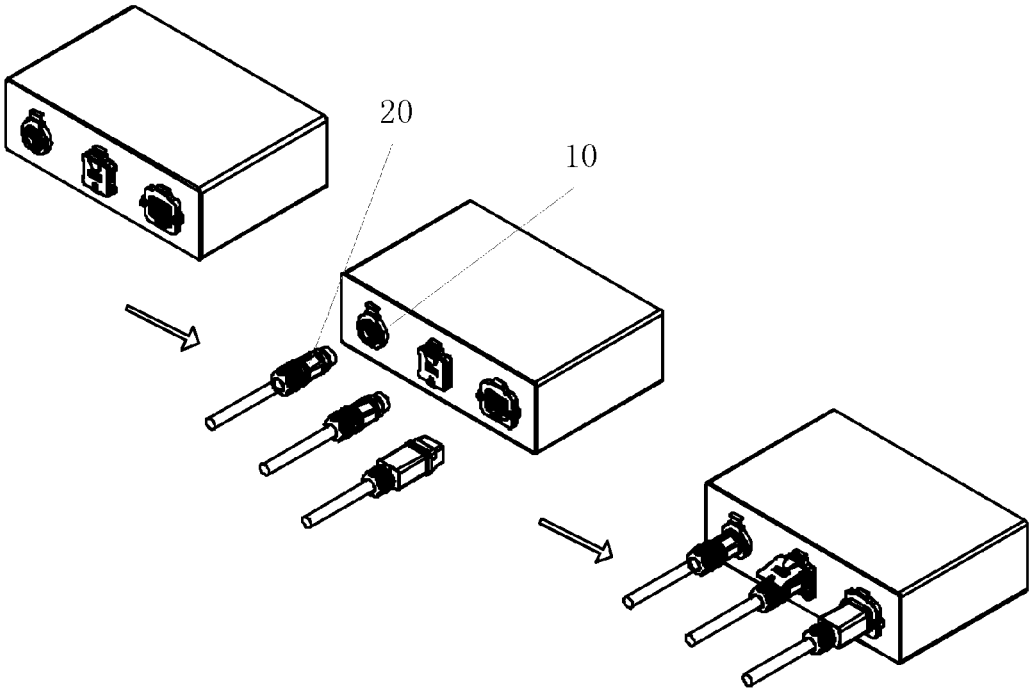

As a further improvement of this embodiment, as shown in FIGS. 12 and 13, the lock catch includes a first lock ring 1110 and a second lock ring 1111, which are of an open-ring structure. The first lock ring 1110 and the second lock ring 1111 surround the outer edge of the through hole on the connecting base 10 to form a circular ring. A first snap fastener 1101 is connected to the first lock ring 1110, and a second snap fastener 1102 is connected to the second lock ring 1111. The first snap fastener 1101 and the second snap fastener 1102 are provided symmetrically. The elastic component comprises a third torsion spring 33 and a fourth torsion spring 34. One end of the third torsion spring 33 is fixedly connected to the first lock ring 1110, while the other end thereof is connected to the connecting base 10. One end of the fourth torsion spring 34 is fixedly connected to the second lock ring 1111, while the other end thereof is connected to the connecting base 10. Gaps 102 are symmetrically provided on the connecting base 10. The first snap fastener 1101 is extended outwards along the gap 102103 from the first lock ring 1110 to the outside of the connecting base 10, and the second snap fastener 1102 is extended outwards along the gap 102 from the second lock ring 1111 to the outside of the connecting base 10. Meanwhile, by pressing the first snap fastener 1101 and the second snap fastener 1102 to opposite directions, the first lock ring 1110 and the second lock ring 1111 are moved inward; and, when the first lock ring 1101 and the second snap fastener 1102 are released, due to the action by the spring, the first lock ring 1110 and the second lock ring 1111 return to their original positions.

In this technical solution, a lock catch structure having two lock rings 1111 is disclosed. By two pushers, the misaligned movement of the two lock rings 111 can be realized, that is, the two lock rings 111 are different in the direction of translation. In this way, the whole lock catch will have a wide opening/closing range, the number and position of the buckles is not limited, and the fixation mode is more diversified.

In this technical solution, the two pushers are protruded from the edge of the holder and approximately located in the same plane with the lock rings; and, the end face of the whole holder is relatively flat, and the industrial connector will not protrude from the surface of the equipment when being fixed on the equipment. It is hard to avoid collision during the transportation and usage of the equipment. The pushers can be effectively protected from damage in this technical solution. Moreover, since the two pushers need to pass through the holder and the panel, the holder and the panel must be widened at positions corresponding to the pushers. Therefore, by directly forming a recessed assembly region in the roots of the pushers to fix the elastic component, the elastic component can share the space for the pushers, and no additional space is needed to accommodate the elastic component. Accordingly, it is advantageous to reduce the size of the holder and the panel and realize the miniaturization of the industrial connector.

A buckle can be provided on each of the first lock ring 1110 and the second lock ring 1111, and the buckle on the first lock ring 1110 and the buckle on the second lock ring 1111 are provided symmetrically. Of course, it is also possible that two or more buckles are provided on each of the first lock ring 1110 and the second lock ring 1111, and the buckles on the first lock ring 1110 and the buckles on the second lock ring 1111 are provided symmetrically. Corresponding buckle structures for connecting the buckles are provided on the sleeve 201 of the plug 20. As a preferred implementation of this embodiment, two buckles can be provided on each of the first lock ring 1110 and the second lock ring 1111, and the buckles on the first lock ring 1110 and the buckles on the second lock ring 1111 are provided symmetrically. Therefore, for those skilled in the art, without paying any creative effort, the number of buckles on each of the first lock ring 1110 and the second lock ring 1111 cannot be limited.

In this technical solution, a fixation structure having four buckle points is disclosed. The plug can be locked in multiple directions, and the fixation is firmer.

An annular buckle is provided on each of the first lock ring 1110 and the second lock ring 1111, and the two annular buckles surround the outer edge of the opening of the connecting cylinder 12 to form a closed ring. Of course, the annular buckles on the first lock ring 1110 and the second lock ring 1111 may not form a closed circular ring, as long as the annular buckles on the first lock ring 1110 and the second lock ring 1111 are provided symmetrically. When the annular buckles are buckled with the clamping structures of the sleeve 201, the uniform surface contact is realized between the annular buckles and the clamping structures of the sleeve 201, so that surface clamping is realized.

In this technical solution, the two buckles form a complete ring, so the plug can be locked completely. This is a fixation method with highest connection strength among various fixation methods using buckles. Moreover, after the plug is locked completely, the clearance between the buckle plate 11 and the plug is very small, and the anti-dust and partially waterproof effects can be achieved.

Each buckle comprises a buckle base and a buckle platform extending into the connecting cylinder 12 along the buckle base. An avoiding groove 1064 for avoiding the buckle base is provided on the connecting base 10, and the buckle base is located on the avoiding groove 1064 in a translational manner. An arc-shaped flange is provided on one side of the buckle base facing the outside of the lock ring 111, and an oblique guide surface is provided on the buckle platform in an axial direction. Since an oblique guide surface is provided on the buckle platform, automatic buckling can be easily realized during the buckling process, and it is convenient for the buckling of the holder 100 and the plug 20.

In this embodiment, one shape of the buckle is disclosed. On one hand, the buckle base can improve the fixation strength of the whole buckle, and it is less likely to damage the buckle by a large plugging/unplugging force. The fitting of the buckle base with the avoiding groove 1064 also limit, to some extent, the translation range of the buckle plate. Meanwhile, in this technical solution, a surface fixation way is disclosed, that is, the buckle is a continuous strip. In this way, the contact area can be increased, and the connection strength can be improved.

As a further improvement of this embodiment, a panel 13 is covered on the surface of the connecting base 10; a pressing surface is provided in the root of the snap fastener 110; protruded side bars are provided at two ends of the pressing surface; the two protruded side bars are connected to two ends of the lock ring 111; and, the elastic component is provided within an assembly region provided by the pressing surface and the two side bars. Correspondingly, the elastic component comprises a first torsion spring 31; a protruded fixing column is provided on the holder within the assembly region; a protruded baffle is provided on the edge of the holder at the opening of the connecting cylinder; the first torsion spring is sleeved on the fixing column; and, one end of the first torsion is rested against the baffle, while the other end thereof is rested against the pressing surface. The panel 13 includes a limiting plate 131, a limiting hole 132 and a center hole provided in the center of the panel 13. An annular flange 133 is extended along the edge of the center hole. Vias 134 for allowing the buckles to pass through are provided on the flange 133. Buckle holes 135 are provided on the four side walls of the panel 13. The panel 13 is sleeved on the outer side wall of the connecting base 10. Hooks on the connecting base 10 are clamped into the buckle holes 135 of the panel 13. The limiting hole 132 on the panel 13 coincides with the fixing hole 107 on the connecting base 10. The limiting plate 131 is provided on an outer side of the side wall of the panel 13. The limiting plate 131 is located in the same direction as the buckle plate 11 of the connecting base 10. Two shaft holes 136 are provided on the limiting plate 131.

In this technical solution, a fitting structure of a snap fastener and an elastic component is disclosed. Since the snap fastener needs to pass through the holder 100 and the panel 13, the connecting base 10 and the panel 13 must be widened at positions corresponding to the snap fastener. Therefore, by directly forming a recessed assembly region in the root of the snap fastener to fix the elastic component, the elastic component can share the space for the snap fastener, and no additional space is needed to accommodate the elastic component. Accordingly, it is advantageous to reduce the size of the holder 100 and the panel and realize the miniaturization of the industrial connector.

In the concept of the present invention, using the torsion spring as the elastic component is especially advantageous. Firstly, the torsion spring has lower requirements on the material and processes than an elastic sheet, and hence the stability is improved and the costs are reduced. More importantly, the direction of the elasticity of the torsion spring is consistent with the direction of translation of the buckle plate 11, so that it is possible to use the torsion spring in the present invention. However, in conventional industrial connectors, only elastic sheet can be used. Moreover, since the fixing column 104 for fixing the torsion spring is fixed vertically, that is, in a direction perpendicular to the direction of translation of the buckle plate 11, the translation of the buckle plate 11 will not be hindered. In this way, the difficulty of design and production is reduced greatly, and it is advantageous to reduce the design and production costs. In addition, the two ends of the torsion spring can be moved in a misaligned manner, a larger stroke range can be provided to the snap fastener within the holder 100 with a limited space, and the reliable release of the buckle plate 11 can be ensured.

The pusher comprises a prod plate integrated with the lock ring 111. The lock ring 111 surrounds the outer edge of the through hole on the connecting base 10. Buckles are provided on an inner edge of the lock ring 111. The prod plate is extended from the gap 102 to the outside of the side wall of the holder. The baffle 103 is provided on the connecting base 10, and the baffle 103 is provided at the side opposite to the prod plate and away from the through hole of the connecting base 10. One end of the spring is rested against the baffle 103, while the other end thereof is fixedly connected to the side wall of the connecting base 10. When the prod plate is prodded outward, the lock ring 111 drives the buckles to translate outward. When the prod plate is released, the lock ring 111 returns to its original position.

Two platforms are provided on the inner wall of the connecting cylinder 12. A waterproof gasket is mounted on the platform close to the bottom. The waterproof gasket is rested against the platform by the bottom end of the sleeve of the plug 20. A waterproof collar is sleeved on the sleeve and located on the other platform on the inner wall of the connecting cylinder 12.

In this technical solution, a waterproof structure of the connecting cylinder 12 is disclosed. A stepped surface close to the opening is used for fitting with the outer side wall of the plug to form a waterproof structure, and a stepped surface close to the bottom is used for fitting with the end portion of the plug to form a waterproof structure. By the double waterproof structures, the probability of damaging the equipment due to water leakage can be decreased greatly, and it is particularly suitable for the outdoor environment or humid indoor environment.

As a further improvement of this embodiment, the holder 100 includes a connecting base 10, a buckle plate, a connecting cylinder 12, a panel 13, a cover plate 14, a gasket 15, a waterproof collar 16, a rubber core assembly 18 and a waterproof gasket 19. The rubber core assembly 18 is encased in the connecting base 10, and the waterproof gasket 19 and the waterproof collar are mounted on platforms on the side wall of the connecting cylinder 12. An elastic component is encased in a fixing column 104. The buckle plate is mounted on the connecting base 10. The panel 13 is sleeved on a side wall 105 of the connecting base 10 and folded with the connecting base 10. The waterproof gasket 17 is adhered on the bottom of the cover plate 14. A spring is connected to the cover plate 14 and the connecting base 10 by a lateral pin.

Further, a hook is provided on the cover plate 14. The cover plate 14 can be turned over in a movement. A slot matched with the hook is provided on the plug 20. By turning over the cover plate 14, after the plug 20 and the holder 100 are fitted, the hook on the cover plate 14 is clamped into the slot on the plug 20 to realize clamping. In this way, one more hook structure can be provided at the connection point, and the connection of the plug 20 and the holder 100 is firmer.

This embodiment provides a plug 20 for an industrial connector. The plug 20 includes a sleeve, and a cable positioning structure fixed to an end of the sleeve 201. The sleeve 201 is an integrally formed hollow body. The sleeve 201 is hollow, and a space for accommodating a cable joint is provided within the sleeve 201. A clamping structure is provided at the end of an outer wall of the sleeve 201 close to the cable positioning structure.

In the present invention, with only one jacket, the plug 20 can realize the fixation of a cable joint and the fitting with the holder of the industrial connector; the clamping structure is directly formed on the outer wall of the sleeve 201 so as to form an integrated structure; and, the external structure of the whole plug 20 is very simple. Since the structure is simpler, the degree of integration is higher, and it is easier to manufacture. The labor-consumption for assembling is greatly reduced, and the production efficiency can be significantly increased. Since the product is simple in structure, the probability of errors between parts of the product when in use is reduced. In addition, the position of the clamping structure directly influences the design of the waterproof structure. If the clamping structure is provided at the opening of the sleeve, attention should be paid to avoiding the clamping structure in the design of the waterproof structure. Therefore, the difficulty of design and manufacture will be increased greatly. In the present invention, the sleeve structure is close to one end of the connecting cylinder 12, the wall from the clamping structure to the open end of the sleeve can be inserted into the holder as a whole, and a waterproof structure can be provided on the holder within this section of the wall, with no need to pay attention to avoiding the clamping structure. Accordingly, the design difficulty of the waterproof structure is reduced, the contact area is large, and the waterproof effect is better.

As a further improvement of this embodiment, the sleeve includes a sleeve and a coupling sleeve. The sleeve 201 is integrated with the fixing cylinder 202. The sleeve 201 may be made of metal material or other material applicable to the industrial connector. The sleeve 201 is used to be fitted and fixed with a holder 100 of the industrial connector. The sleeve includes a first sleeve body 2011 and a second sleeve body 2012. An outer surface of the second sleeve body 2012 is higher than that of the first sleeve body 2011. A stepped surface is provided at a junction of the first sleeve body 2011 and the second sleeve body 2012. A waterproof collar for the purpose of waterproofing is provided on the stepped surface. A clamping structure is provided on the second sleeve body 2012. By connecting the clamping structure on the second sleeve body 2012 to the holder 100 of the industrial connector, the buckling connection is realized. It is also possible to provide an annular groove between the first sleeve body 2011 and the second sleeve body 2012. The waterproof collar 16 is embedded into the annular groove for the purpose of waterproofing. It is also possible that the waterproof collar 16 is sleeved on both the first sleeve body 2011 and the second sleeve body 2012, or sleeved on the first sleeve body 2011 or the second sleeve body 2012.

Therefore, for those skilled in the art, without paying any creative effort, any method for mounting the waterproof collar 16 shall be regarded as the disclosure of this embodiment.

By designing the platform, the outer wall of the whole sleeve 201 is bent at the platform to fit with the holder, so that a waterproof structure can be realized. The first sleeve body 2011 and the second sleeve body 2012 on the sleeve 201 may also be integrally formed, the waterproof collar 16 is directly sleeved on the integrated sleeve 201, or the first sleeve body 2011 and the second sleeve body 2012 have their centers located in a same axis with a same outer diameter.

In this embodiment, a sleeve 201 of a single-sleeve structure is disclosed. Therefore, the sleeve may be manufactured from a hollow tube in a standard shape (e.g., cylinder, rectangle, ellipse, polygon or the like), so that the design and production costs of the sleeve are reduced.

The clamping structure includes a notch 206. The notch 206 includes a side wall and a first bottom surface 204 connected to the root of the side wall. A protruded portion 205 in buckling connection with the holder 100 is provided on the side wall.

In this technical solution, a specific hook structure is disclosed. With the notch 206 on the outer wall of the sleeve 201, the notch 206 will naturally form a side wall 203 intersected with the outer wall of the sleeve, and a protruded portion 205 is then provided on the side wall 203. The first bottom surface 204 functions to form a hook and also guides a user to plug or unplug quickly during the assembling process. Moreover, the buckle structure fitted with the holder must be firstly embedded into the first bottom surface 204 and then fitted with the hook along the first bottom surface 204. Therefore, a certain poka-yoke effect is realized.

The first bottom surface 204 is obliquely extended from the root of the side wall 203 to an outer surface of the sleeve 201, and an introduction face is provided on one side of the protruded portion 205 facing the holder of the industrial connector.

Specifically, the first bottom surface 204 may be an oblique plane or curved surface, and this will not be limited herein. The introduction face is an oblique curved surface or an oblique plane, and this will not be limited here.

In this technical solution, only one side wall 204 is required for the notch 206, and the first bottom surface 204 is obliquely provided so that the natural transition to the surface of the outer wall of the sleeve 201 can be realized. In this way, the wall of the sleeve 201 at the position opposite to the side wall 203 is relatively thin and then gradually thickened, and the structural strength of the whole sleeve is high.

Specifically, the side wall 203 includes a first side wall 2301 and a second side wall 2302; two sides of the first bottom surface 204 are connected to the roots of the first side wall 2301 and the second side wall 2302, respectively; the protruded portion 205 includes a clamping strip; the clamping strip spans over the first bottom surface 204 and is connected to the first side wall 2301 and the second side wall 2302, respectively; and, the length of the clamping strip does not exceed half of the length of the outer circumference of the second sleeve body 2012.

In order to further describe this embodiment, a notch 206 is provided on the sleeve, and two sides of the notch 206 is a first side wall 2301 and a second side wall 2302. The distance between the first side wall 2301 and the second side wall 2302 may be adjusted as required. However, the distance between the first side wall 2301 and the second side wall 2302 does not exceed half of the length of the circumference of the sleeve 201.

In this technical solution, the notch 206 has two side walls, so that the length of the hook can be further increased, the contact area with the buckles of the holder is increased, and the connection strength of the plug 20 and the holder is improved.

If the first sleeve body 2011 and the second sleeve body 2012 form an integrated cylinder, the introduction face and the first bottom surface are extended to the opening of the sleeve. If the first sleeve body 2011 and the second sleeve body 2012 form a stepped surface, the introduction face and the first bottom surface are extended to a junction of the second sleeve body 2012 and the stepped surface.

By designing the platform, the outer wall of the whole sleeve is bent at the platform to fit with the holder, so that the waterproof structure can be realized.

Of course, the sleeve 201 may be an integrally formed third sleeve body. Therefore, the sleeve may be manufactured from a hollow tube in a standard shape (e.g., cylinder, rectangle, ellipse, polygon or the like), so that the design and production costs of the sleeve are reduced.

At least one avoiding gap for avoiding the buckles of the holder 100 is provided on the clamping strip. There are two avoiding gaps which are provided at the two sides of the clamping strip. The avoiding gaps are not connected to either the first side wall 2301 or the second side wall 2302, so as to form a clamping structure.

The avoiding gaps can avoid the buckles of the holder. So the clamping strip is suitable for surface fixation and also point fixation. That is, correspondingly, the clamping structure of the connecting base 10 is of a strip-like structure which can be snapped with the clamping strip. If the clamping structure of the connecting base 10 is a clamping point structure, the clamping structure can also be clamped with the body of the clamping strip after passing through the avoiding gap. Therefore, it has better universality.

The clamping structure includes a third side wall and a fourth side wall, a second bottom surface for connecting the root of the third side wall and the root of the fourth side wall, and a clamping surface for connecting an end of the third side wall and an end of the fourth side wall and being connected to the buckles of the connecting base 10.

In the present invention, the clamping structure is a pit directly provided on the outer wall of the sleeve, and the clamping surface is directly supported on the wall of the sleeve. It is less likely to result in corrosion during the repeated plugging/unplugging process, and it is advantageous to prolong the service life of the clamping structure.

The clamping structure comprises a clamping ring surrounding the outer wall of the sleeve 201, possibly a plurality of protruded portions 205 surrounding the sleeve, or possibly a bayonet 207 running through the outer wall of the sleeve. The form of the clamping structure and the fitting with the buckle structure on the holder 100 realize the clamping fixation of the plug 20 and the holder 100. In this embodiment, there are various forms of clamping structures, but these forms are merely provided for better describing the clamping structure. For those skilled in the art, without paying any creative effort, the clamping structures described in the embodiment shall not be regarded as all clamping structures within the protection scope of the present invention.

In the present invention, the clamping structure is a pit directly provided on the outer wall of the sleeve 201, and the clamping surface is directly supported on the wall of the sleeve. It is less likely to result in corrosion during the repeated plugging/unplugging process, and it is advantageous to prolong the service life of the clamping structure. Furthermore, the clamping structure is a through hole directly provided on the outer wall of the sleeve, and the bayonet is directly supported on the wall of the sleeve. It is less likely to result in corrosion during the repeated plugging/unplugging process, and it is advantageous to prolong the service life of the clamping structure.

As a further improvement of this embodiment, the cable positioning structure includes a nut 21, a cable clamping ring 22, a fixing assembly 23 and a waterproof ring 24; the cable joint includes a rubber core 25; and, a conductive contact connected to the holder is provided at one end of the rubber core 25, while the other end of the rubber core 25 is connected to a cable. The rubber core 25 is incased in the sleeve. The cable clamping ring 22 and the waterproof ring 24 are sleeved on the fixing assembly 23. The fixing assembly on which the cable clamping ring 22 and the waterproof ring 24 are sleeved is in threaded connection with the sleeve 201 by the nut.

In this embodiment, it is also possible to interchange the clamping structure on the plug 20 with the hook structure on the holder 100. That is, a protruded portion, as a clamping structure, is provided on the holder 100, and a buckle plate 11 is provided on the plug 20. The buckle plate 11 is driven to translate along the direction of the opening so that the buckle structure on the buckle plate 11 is detachably fixed to the clamping structure.

Of course, in this embodiment, the industrial connector is fixedly connected to the machine in a detachable way by the holder 100, and the plug 20 is also fixedly connected to the holder 100 in a detachable way. For example, the holder 100 is provided on the machine by welding or directly so as to realize the detachable connection of the plug 20 and the machine, or the plug 20 is firstly fixed to the holder 100 and then fixed to the machine.

Those skilled in the art may make other various corresponding alterations and transformations according to the technical solutions and concepts described above, and all the alterations and variations shall fall into the protection scope defined by the appended claims of the present invention.

The invention claimed is:

1. An industrial connector, comprising a holder and a plug matingly connected to the holder, wherein the holder comprises: a hollow connecting cylinder; a connecting base fixed around an opening of the connecting cylinder; a buckle plate and an elastic component that are fixed within the connecting base, with a buckle embedded in the connecting base being provided on the buckle plate; and the elastic component which is connected to the buckle and used for driving the buckle plate to translate along a plane of the opening;

wherein the buckle plate comprises a lock catch and a pusher that is connected to the elastic component and the lock catch respectively, and the buckle is provided on the lock catch; and the lock catch forms a lock ring of a closed-loop structure, the pusher comprises a snap fastener fixedly connected to the lock ring, and the buckle is provided on an inner side wall of the lock ring.

2. The industrial connector according to claim 1, wherein a shape of the lock ring comprises a circle or a rectangle.

3. The industrial connector according to claim 1, wherein the buckle comprises a first buckle provided opposite to the snap fastener.

4. The industrial connector according to claim 1, wherein the buckle comprises a second buckle and a third buckle which are symmetrically provided at two sides of the snap fastener.

5. The industrial connector according to claim 1, wherein the buckle comprise a first buckle, a second buckle and a third buckle, the first buckle is provided opposite to the snap fastener, and the second buckle and the third buckle are symmetrically provided at two sides of the snap fastener.

6. The industrial connector according to claim 1, wherein the buckle is provided opposite to the snap fastener, the buckle is an annular flange extending along an annular arm of the lock ring, and the length of the annular flange does not exceed half of the perimeter of the lock ring.

7. The industrial connector according to claim 1, wherein an aperture is provided on the connecting base, the aperture is provided with a limiting portion at its edge, the lock ring is accommodated within the connecting base and sleeved on an edge of the limiting portion, the connecting base is provided with a gap at its edge, the snap fastener is integrally connected with the lock ring, and the snap fastener is extended outwards along the gap from the lock ring to the outside of the connecting base.

8. The industrial connector according to claim 1, wherein the connecting base is covered with a panel on its surface, the snap fastener is provided with a pressing surface at its root, the pressing surface is provided with protruded side bars at two ends, the two side bars are integrally connected with two ends of the lock catch respectively, and the elastic component is provided within an assembly region formed by the pressing surface and the two side bars.

9. The industrial connector according to claim 8, wherein the elastic component comprises a first torsion spring; the connecting base is provided with a protruded fixing column within the assembly region, the connecting base is provided with a protruded baffle on an edge of an opening of the connecting cylinder, the first torsion spring is sleeved on the fixing column, and the first torsion spring has one end rested against the baffle and the other end rested against the pressing surface.

10. The industrial connector according to claim 1, wherein the plug comprises a jacket, the jacket comprises a sleeve to be embedded into the holder of the industrial connector and a fixing cylinder connected to the sleeve, a space for mounting a cable joint is provided within the fixing cylinder, a cable positioning structure is provided at one end of the fixing cylinder away from the sleeve, and a clamping structure is formed at one end of an outer wall of the sleeve close to the fixing cylinder;

wherein the sleeve comprises a first sleeve body and a second sleeve body, an outer surface of the second sleeve body is higher than that of the first sleeve body, a mesa to be fitted with the holder of the industrial connector to achieve waterproofing is provided at a joint of the first sleeve body and the second sleeve body, and the clamping structure is provided on an outer wall of the second sleeve body;

wherein the sleeve is an integrally formed third sleeve body;

wherein the clamping structure comprises a first slot, the first slot comprises a side wall and a first bottom surface connected to a root of the side wall, and the side wall is provided with a hook connected to the buckle of the holder;

wherein the first bottom surface is obliquely extended from the root of the side wall to an outer surface of the sleeve, and an introduction face is provided at one side of the hook facing the holder of the industrial connector;

wherein the side wall comprises a first side wall and a second side wall, two sides of the first bottom surface are respectively connected to roots of the first side wall and the second side wall, the hook comprises a clamping strip, the clamping strip spans over the first bottom surface and is connected to the first side wall and the second side wall respectively, and the length of the clamping strip does not exceed half of the outer circumference of the sleeve;

wherein at least one avoiding gap for avoiding the buckle of the holder is provided on the clamping strip;

wherein the clamping structure comprises a third side wall and a fourth side wall, a second bottom surface connecting a root of the third side wall and a root of the fourth side wall, and a clamping surface connecting an end of the third side wall and an end of the fourth side wall to be connected with the buckle of the holder;

wherein the clamping structure comprises a clamping ring surrounding an outer wall of the jacket; and wherein the clamping structure comprises a bayonet penetrating through the outer wall of the jacket.

11. A connecting structure for an industrial connector, comprising the holder according to claim 1.

12. A connecting structure for an industrial connector, comprising the plug according to claim 1.

* * * * *